US007832178B2

(12) United States Patent
Rouse

(10) Patent No.: US 7,832,178 B2
(45) Date of Patent: Nov. 16, 2010

(54) SEGMENTED SUPPORT ASSEMBLY

(76) Inventor: Jon Matthews Rouse, 620 Ashworth Rd., West Des Moines, IA (US) 50265

( * ) Notice: Subject to any disclaimer, the term of this patent is extended or adjusted under 35 U.S.C. 154(b) by 461 days.

(21) Appl. No.: 11/161,374

(22) Filed: Aug. 1, 2005

(65) Prior Publication Data

US 2007/0022705 A1 Feb. 1, 2007

(51) Int. Cl.
*E04C 3/00* (2006.01)

(52) U.S. Cl. ..... 52/835; 52/836; 52/843; 52/219; 52/223.1; 52/223.4

(58) Field of Classification Search ..... 52/223.1, 52/223.4, 223.5, 721.5, 723.2, 721.2, 219, 52/169.9, 223.9, 835, 836, 843
See application file for complete search history.

(56) References Cited

U.S. PATENT DOCUMENTS 1,420,430 A * 6/1922 Friedrich et al. ..... 403/312
1,529,895 A * 3/1925 La Chance et al. ..... 52/223.5
1,545,456 A * 7/1925 Rastetter ..... 52/295
1,675,093 A * 6/1928 Conley ..... 52/351
3,201,834 A * 8/1965 Baittinger ..... 403/312
3,295,275 A * 1/1967 Carlsen ..... 52/168
3,348,812 A * 10/1967 Story ..... 254/223
3,430,397 A * 3/1969 Ellis ..... 52/223.7
3,521,917 A * 7/1970 King ..... 403/2
3,962,088 A * 6/1976 Kuhlenschmidt et al. ..... 210/170.01
4,032,248 A * 6/1977 Parduhn et al. ..... 404/10
4,097,165 A * 6/1978 Quayle ..... 403/286
4,327,703 A * 5/1982 Destree ..... 125/1
4,697,396 A * 10/1987 Knight ..... 52/170
4,910,940 A * 3/1990 Grady, II ..... 52/726.3
4,987,718 A * 1/1991 Knight ..... 52/741.14
5,675,943 A 10/1997 Southworth
5,813,800 A * 9/1998 Doleshal ..... 405/232
6,202,371 B1 * 3/2001 Natelli, Jr. ..... 52/170
6,267,529 B1 * 7/2001 Mudryk et al. ..... 404/10
6,626,410 B2 * 9/2003 Marcotte et al. ..... 248/548
6,851,231 B2 * 2/2005 Tadros et al. ..... 52/223.4
6,868,641 B2 * 3/2005 Conner et al. ..... 52/98
6,901,717 B2 * 6/2005 Brunozzi et al. ..... 52/723.1
6,915,618 B2 * 7/2005 Payne ..... 52/736.1
6,938,392 B2 * 9/2005 Fouad et al. ..... 52/834
6,973,755 B2 * 12/2005 Pott ..... 52/223.8
2004/0020158 A1 * 2/2004 Kopshever, Sr. ..... 52/723.2

OTHER PUBLICATIONS

PCI Journal, The PRESSS Five-Story Precast Concrete Test Building, LaJolla, California, Sep.-Oct. 2001.
Yahya C. Kurama, Seismic Design of Unbounded Post-Tensioned Precast Concrete Walls with Supplemental Viscous Damping, ACI Structural Journal—Jul.-Aug. 2000.
Yahya C. Kurama, Richard Sause, Stephen Pessiki and Lee-Wu Lu, Selsmic Response Evaluation of Unbonded Post-Tensioned Precast Walls, ACI Structural Journal, Sep.-Oct. 2002.

* cited by examiner

*Primary Examiner*—Richard E Chilcot, Jr.
*Assistant Examiner*—Mark R Wendell

(57) ABSTRACT

A column includes a foundation, a plurality of column segments mounted to the foundation and extending upwardly, and a cap mounted to at least one of the plurality of column segments. A yield plate connects adjacent column segments to one another. An elastic strip connects to an exterior surface of at least two of the plurality of column segments and is adapted to permit deformation between the plurality of column segments and also return the plurality of column segments to their original orientation. A banding strip is connected at a junction between adjacent column segments and is adapted to limit the movement of the adjacent column segments at the junction.

15 Claims, 4 Drawing Sheets

SEGMENTED SUPPORT ASSEMBLY

BACKGROUND OF THE INVENTION

This invention is directed toward segmented concrete column or pole for use in structural support.

In the structural support industry, segmented concrete columns are typically used in pier constructions where the columns include small, easily handled segments. The segments are precast with aligned ducts to allow for threading of post-tensioning strands through the column once the segments are placed in the field. Segments are often match-cast (i.e., each consecutive segment is used as a form for the next segment) to ensure a close fit and duct alignment for rapid field assembly. The ends of each column segment typically have formed shear keys to facilitate shear transfer between segments and are bonded together in the field with an appropriate structural epoxy. Once the column is assembled, post-tensioning strands are placed through the ducts and tensioned to a predetermined stress level to satisfy both service and ultimate limit state requirements for the pier.

The segmented column provides economic and aesthetic advantages usually ascribed to any precast concrete system. Because the concrete is cast at the plant rather than in the field, environmental conditions that are crucial to freshly placed concrete may be more closely monitored and controlled. The usual result is higher quality concrete that is more durable over the life of a structure. The precise pieces may be cast earlier in the project schedule and then be assembled in the field more quickly than cast-in-place structures thus reducing construction time. Architectural finishes may also be more expediently applied in the plant providing a wider range of appearances for the completed structure. This type of construction can yield significant cost reductions in construction.

The main structural reasons for pre- or post-tensioning any columns or poles are to increase moment capacity and lateral stiffness thus allowing more slender, attractive geometries and to improve durability by minimizing cracking. With an unbonded post-tensioned (UBPT) system in which the concrete is not bonded to the strands, the column has some fundamentally different behavior than a column that is either pre-tensioned or whose strands are grouted in place after post-tensioning. In contrast to the unbonded strands, bonded reinforcement (either mild steel or strand) experiences stress concentrations at flexural cracks in the concrete. These areas on the reinforcement often yield, allowing the primary mechanism for hysteretic energy dissipation and ductility in the column. When the strands are unbonded, stress is not concentrated locally but distributed uniformly along the full length of the strand.

In columns with bonded reinforcement, energy absorption facilitates redistribution of loads and allows changes in damping characteristics of a structure when seismically loaded. On the other hand, because energy absorption is usually achieved through plastic deformation of primary reinforcements, the structure is typically left with large, permanent deformations and cracks. Conversely, the nonlinear but relatively elastic behavior of columns with unbonded reinforcement results in much less energy being dissipated raising concerns of larger deformations under seismic load and sudden, catastrophic failure. Thus, unbonded columns are typically not used in seismic regions. The advantages of the nonlinear elastic behavior are that residual deformations after removal of the load are minimal and post-tensioning force is not lost. As a result, the structure may remain in service or have reduced repair costs after a major earthquake or impact loading.

While segmented columns with either bonded reinforcement or unbonded reinforcement have solved many problems in the art, many other problems still remain.

One objective of this invention is to provide a segmented support including a yield plate connecting adjacent column segments to one another.

Another objective of this invention is to provide a segmented support including elastic strips connected to an exterior surface of the column and adapted to permit deformation between the column segments and return the column segments to their original orientation.

A further objective of this invention is to provide a segmented support including banding strips embedded into column segments at predetermined connection locations wherein the banding strips are adapted to provide confinement to concrete at high stress locations, and prevent spalling.

These and other objectives will be apparent to those skilled in the art based on the following disclosure.

SUMMARY OF THE INVENTION

A support such as a column or pole rests upon a foundation and includes a plurality of column segments mounted to the foundation and extending upwardly. A cap may be mounted to at least one of the plurality of column segments. A yield plate connects adjacent column segments to one another. An elastic strip connects to an exterior surface of at least two of the plurality of column segments and also aid in returning the plurality of column segments to their original position and orientation. Embedded banding strips extend around the column at predetermined locations to provide connections for yield plates and elastic strips, provide confinement to concrete at high stress locations, and prevent spalling.

DETAILED DESCRIPTION OF THE PREFERRED EMBODIMENT

Figure 1:
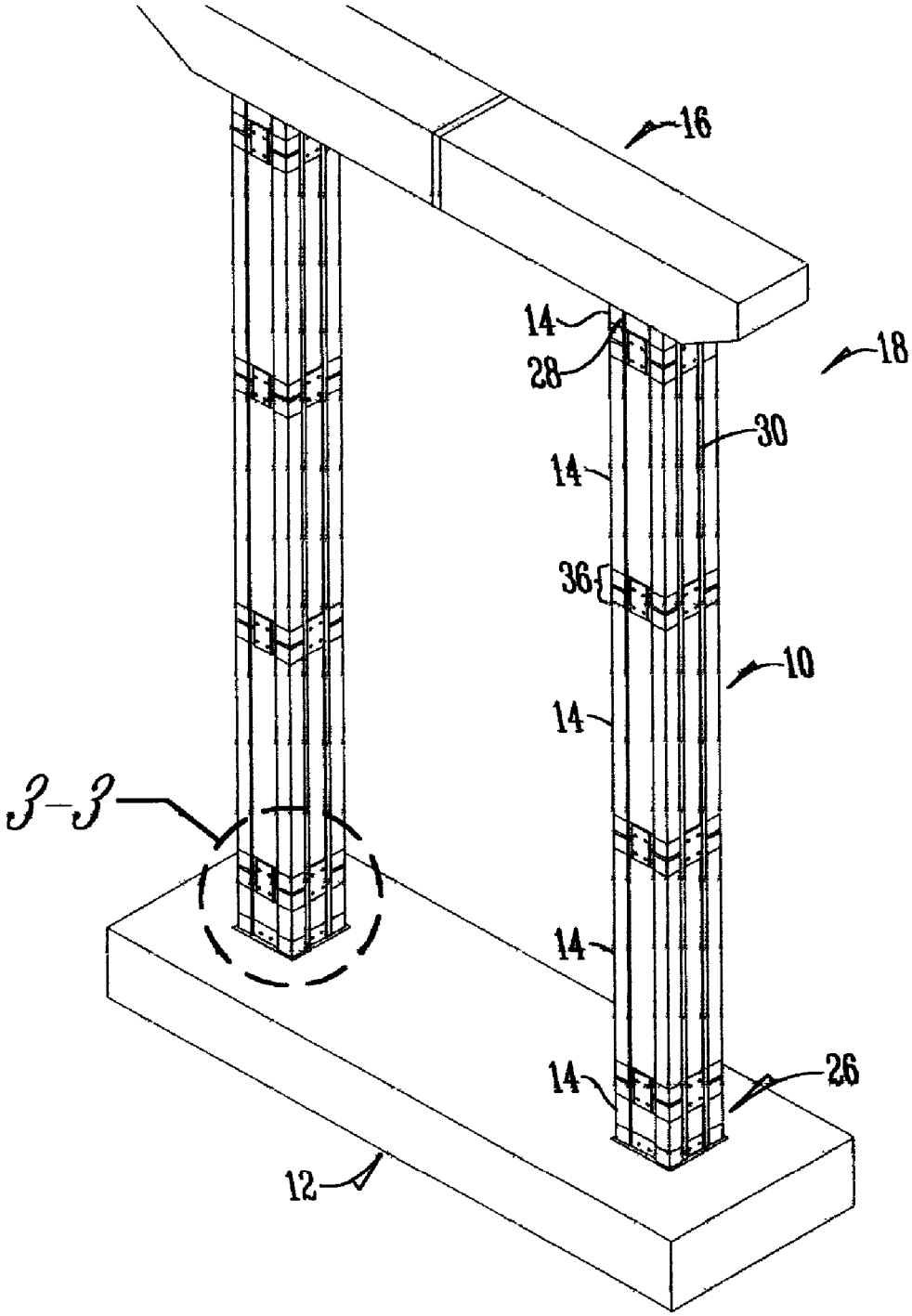
FIG. 1 is a perspective view a column.

Referring to FIG. 1, a column 10 rests upon a foundation 12, and includes a plurality of column segments 14 mounted to the foundation 12 and extending upwardly therefrom, and a cap 16 mounted to the top most column segment 14. Individual column segments 14 are internally strengthened with embedded reinforcements. While described as a column and illustrated herein as a column 10 in a bridge pier 18, it is understood that the invention alternatively is a column in a building of single or multiple stories with beams and slabs or as a cantilever pole in various applications. Although FIGS. 1-4 illustrate columns 10 of square cross section, alternatively the same components described herein are equivalently applicable to columns of any solid cross-sectional shape as well as hollow columns. Also, it is understood that the column segments 14 are internally strengthened with embedded reinforcements.

Figure 2:
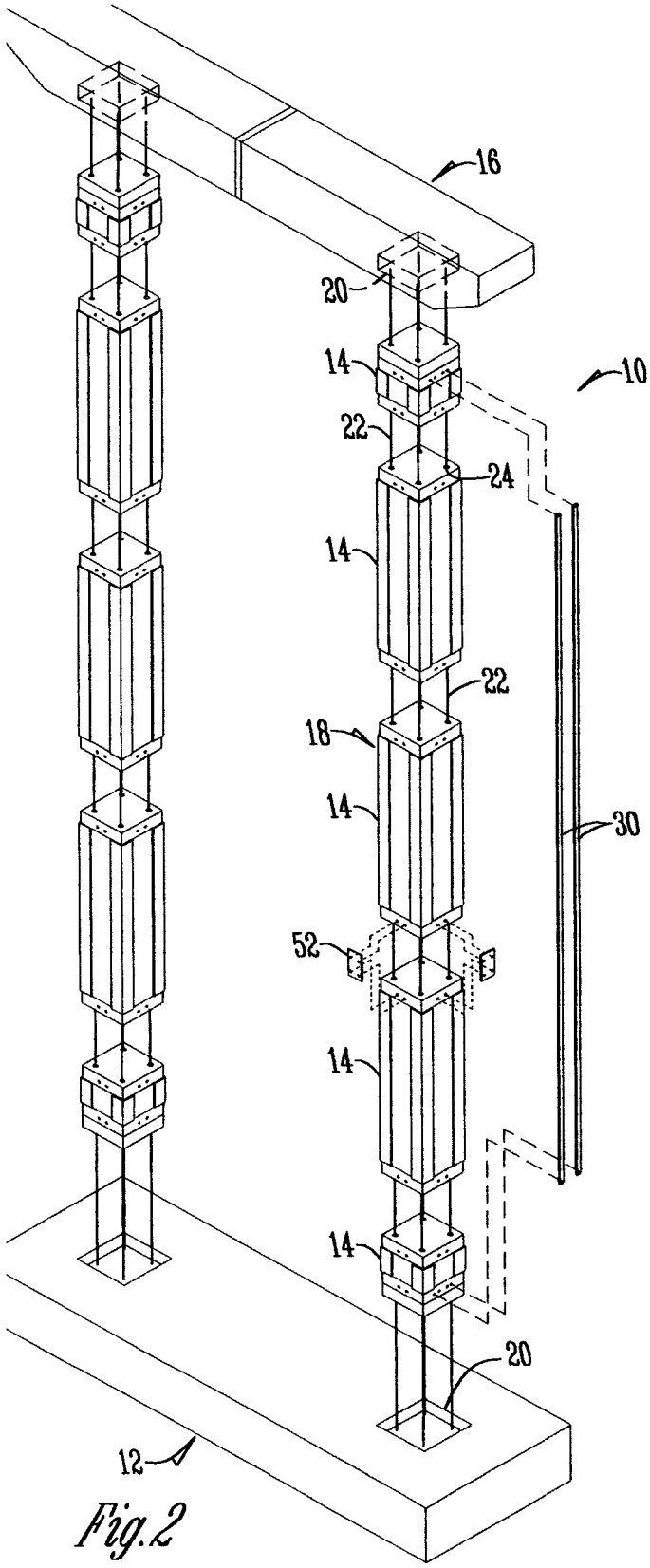
FIG. 2 is an exploded perspective view of the column of FIG. 1 with banding strips removed.

Referring to FIGS. 1 and 2, the column segments 14 form a column 10 extending vertically from the foundation 12 to the cap 16. The column 10 may be secured to the foundation 12 and the cap 16 in any one of several methods. As shown in FIG. 2, the foundation 12 and cap 16 may include respective pockets 20 formed as a depression in the foundation 12 and cap 16 and adapted to receive the column 10.

In embodiments where tensioning strands 22 are utilized, the tensioning strands 22 are located within ducts 24 formed to extend through the column segments 14. When assembled, the tensioning strands 22 are designed so as to be both in unbonded condition and unyielding even when the column 10 reaches its ultimate lateral load capacity.

Figure 3:
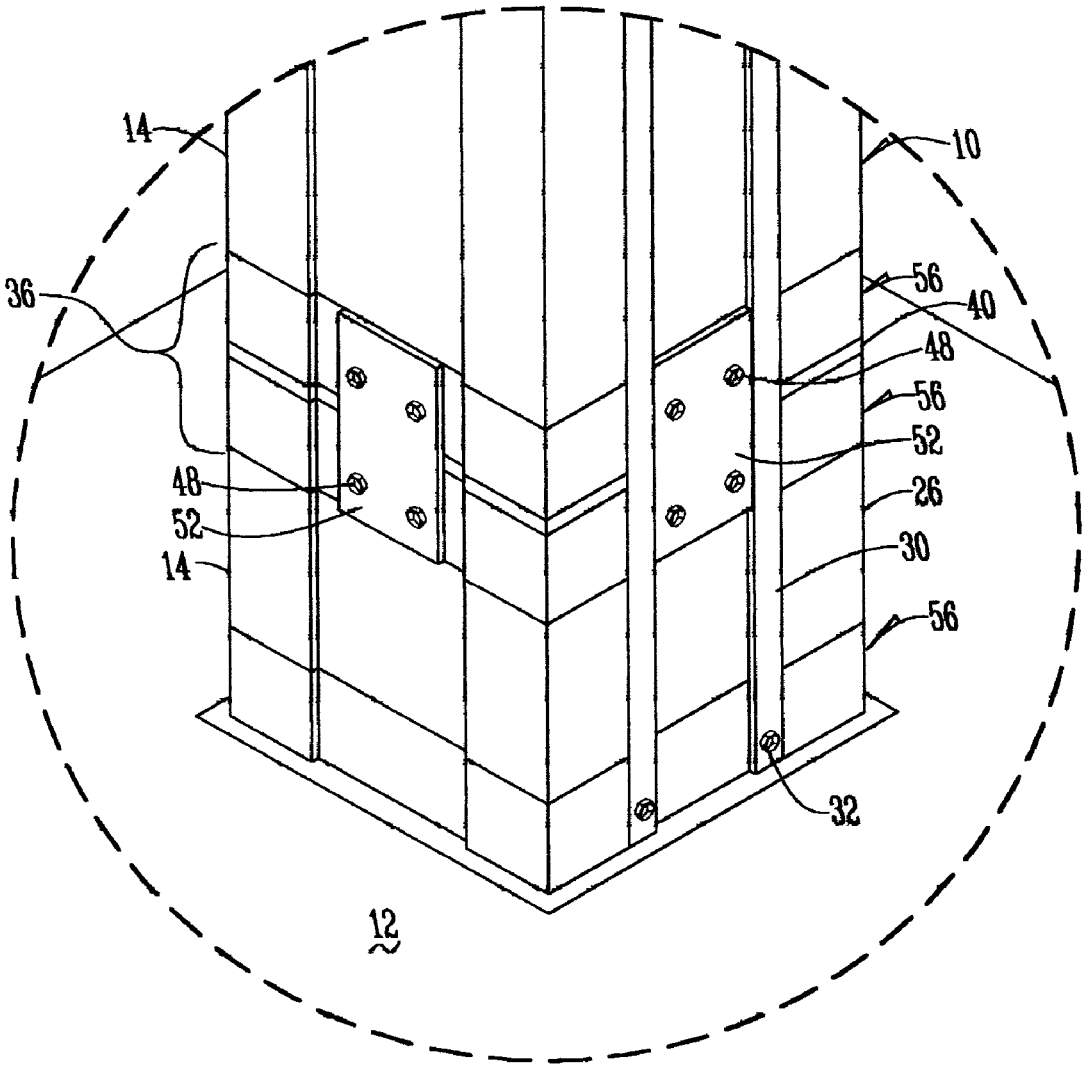
FIG. 3 is an enlarged perspective view of the column of FIG. 1 at 3-3.

Referring to FIGS. 1 and 3, when fully assembled the column 10 includes a base segment 26 near the foundation 12 and a crown segment 28 positioned adjacent the cap 16. Elastic strips 30 are secured to the crown segment 28 as well as the base segment 26 to extend the length of the column 10 on an exterior of segments 14. Elastic strips 30 may be secured to the column 10 by any suitable method. As shown, for example, elastic strips 30 are secured to the column 10 via through bolts 32 fastened to the column 10. Further, the attachment of the elastic strips 30 at the base segment 26 and crown segment 28 of the column 10 reduces the likelihood of yield or fracture of the elastic strips 30 at a junction 36 between column segments 14 and helps to return the column 10 to its original position after being deformed laterally.

The elastic strips 30 may be formed of any suitable material, for example, long strips of fiber composites or high strength steel. Carbon, Kevlar, or even glass composites, or the like are suitable fiber composites for the elastic strips 30. The elastic strips 30 are designed not to yield. The elastic strips 30 help ensure ductility by picking up increasing tensile loads as the column 10 experiences large lateral deformations and thus help to return the column 10 to its original shape and reduce residual deformations.

Figure 4:
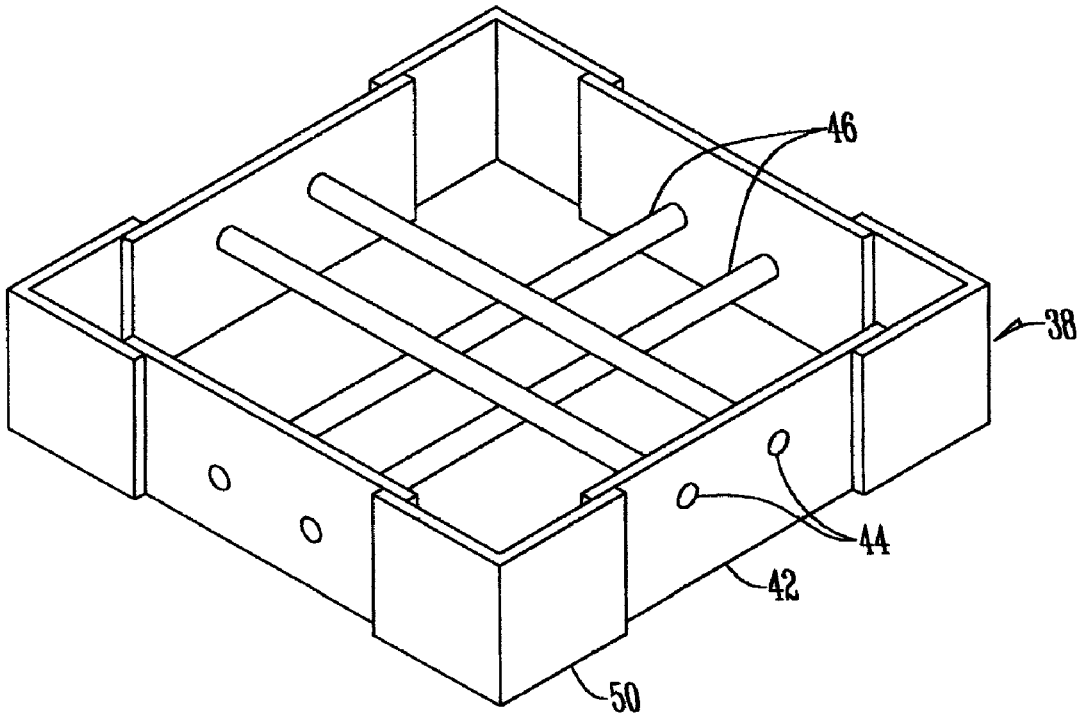
FIG. 4 is a perspective view of a banding strip before being cast into a column segment.

Referring to FIGS. 3 and 4, banding strips 56 are located at each junction 36 where two column segments 14 meet and as well as where the base segment 26 and crown segment 28 fit into the pockets 20 of the foundation 12 and cap 16. The banding strips 56 are cast into the column segments 14 and adapted to provide an apparatus for connection of exterior reinforcements, provide confinement to the concrete at high stress locations, and prevent spalling. The ends of the column segments 14 are thus reinforced by the banding strips 56 and are secured together by a grout layer 40. The grout may be epoxy based and/or fiber reinforced.

Referring to FIG. 4 each banding strip 56 includes a plate section 42 having apertures 44 therein. The apertures 44 are in alignment with through ducts 46 adapted to receive through bolts 48 that extend through the column segment 14 to a second plate section 42 positioned on the opposite side of the banding strip 56. A plurality of corner sections 50 connect the plate sections 42 together. The assembled banding strip 56 is positioned inside the concrete form and cast integrally with a column segment 14.

Referring to FIG. 3, yield plates 52 connect adjacent column segments 14 to one another. The yield plates 52 may be connected by any suitable method. For example, as shown, yield plates 52 are mounted to adjacent column segments 14 with through bolts 32 or 48 extending between opposing sides of each column segment 14. Yield plates 52 serve to transfer tension, compression, and shear from one column segment 14 to the next. They are designed to deform plastically under severe lateral load conditions in order to provide ductility and energy dissipation capability. After the lateral loading event, permanently deformed yield plates 52 are unbolted allowing for additional reduction in residual deformation. Replacements are cheaply and easily bolted back into position.

In operation, the elastic strips 30, yield plates 52, and banding strips 56 all serve to improve the functioning of the column 10. Specifically, the elastic strips 30 operate to limit the column 10 movement, allow for deformation without collapsing, and aid in returning the column 10 to its original shape after the application of lateral load. The yield plates 52 are adapted to deform plastically under lateral load and are also adapted to be easily replaceable. These features of the yield plates 52 result in the damage to column 10 being localized in the yield plates 52 where the damage may be easily fixed by replacement of the yield plates 52. Lastly, banding strips 56 provide structural reinforcement to the junctions 36 between adjacent column segments 14 to limit damage to column segments 14 when the column 10 is placed under lateral loads.

It is therefore seen that the column will accomplish at least all of its stated objectives.

What is claimed is:

1. A column, comprising:

a plurality of column segments;

a first yield plate connecting adjacent column segments to one another through connection to a second yield plate, wherein the first yield plate is connected to the second yield plate by a through bolt extending between opposing sides of each column segment; and tensioning strands that extend longitudinally through the column segments.

2. The column of claim 1, further comprising an elastic strip connected to an exterior surface of at least two of the plurality of column segments, the elastic strip adapted to permit deformation between the plurality of column segments and also return the plurality of column segments to their original orientation.

3. The column of claim 1, further comprising a banding strip embedded within at least one column segment having a first banding strip plate section connected to a second banding strip plate section by a through duct extending through the column segment.

4. The column of claim 2, further comprising a banding strip embedded within at least one column segment.

5. The column of claim 2 further comprising tensioning strands that extend through the column segments.

6. The column of claim 5 further comprising a banding strip embedded within at least one column segment.

7. The column of claim 1 further comprising a banding strip embedded within at least one column segment.

8. A column comprising:

a plurality of column segments;

an elastic strip connected to an exterior surface of at least two of the column segments, the elastic strip secured to a crown segment and a base segment of the column and extending therebetween the elastic strip adapted to permit deformation between the plurality of column segments and also return the plurality of column segments to their original orientation; and a plurality of tensioning strands extending through each column segment.

9. The column of claim 8 further comprising a banding strip embedded within at least one column segment.

10. A column, comprising:

a plurality of column segments;

a plurality of yield plates mounted to an exterior surface of adjacent column segments to connect one another; a banding strip embedded within at least one column segment; and wherein the yield plates deform plastically under lateral load conditions to provide ductility and energy disspation.

11. The column of claim 1 further comprising the tensioning strands extending through a substantial length of the column.

12. The column of claim 1 further comprising the tensioning strands extending through the column in an unbonded condition.

13. The column of claim 2 further comprising the elastic strip extending the length of the column.

14. The column of claim 2 further comprising the elastic strip connected to a crown segment and a base segment.

15. The column of claim 10 further comprising the banding strip having a through duct extending through the column segment.

* * * * *